US007628278B2

(12) United States Patent
Coppola

(10) Patent No.: US 7,628,278 B2
(45) Date of Patent: Dec. 8, 2009

(54) PACKAGING ARRANGEMENT FOR ARTIFICIAL NAILS

(75) Inventor: Jeanine Coppola, Irvine, CA (US)

(73) Assignee: Pacific World Corporation, Lake Forest, CA (US)

( * ) Notice: Subject to any disclaimer, the term of this patent is extended or adjusted under 35 U.S.C. 154(b) by 454 days.

(21) Appl. No.: 11/634,547

(22) Filed: Dec. 6, 2006

(65) Prior Publication Data

US 2007/0151898 A1 Jul. 5, 2007

Related U.S. Application Data

(60) Provisional application No. 60/742,715, filed on Dec. 6, 2005.

(51) Int. Cl.
*B65D 23/12* (2006.01)

(52) U.S. Cl. ..... 206/733; 206/581; 206/823; 206/815; 206/476; 132/75

(58) Field of Classification Search ..... 132/73, 132/73.5, 75, 286; 206/581, 823, 815, 733, 206/734, 476, 486, 775; 211/192, 72, 73; 40/642.02, 649, 657; 248/224.8, 225.11, 248/220.31

See application file for complete search history.

(56) References Cited

U.S. PATENT DOCUMENTS 549,613 A 11/1895 Richardson
615,702 A * 12/1898 Hills ..... 206/486
2,788,123 A 4/1957 Levis et al.
3,512,287 A * 5/1970 Stern ..... 40/124
3,578,158 A * 5/1971 Aylott ..... 206/509
3,598,246 A * 8/1971 Galli ..... 211/49.1
3,982,551 A 9/1976 Bartolucci
4,106,614 A 8/1978 Aylott
4,140,139 A 2/1979 Aylott
4,181,220 A * 1/1980 Zicko ..... 206/315.2
4,282,975 A 8/1981 Ovadia
4,488,654 A * 12/1984 Odsgard ..... 312/34.8
4,596,260 A * 6/1986 Giuliano ..... 132/73
5,147,038 A * 9/1992 Pergeau ..... 206/373
5,791,482 A 8/1998 Murphy et al.
5,813,415 A 9/1998 Slali
5,816,408 A 10/1998 Indelicato
5,894,928 A 4/1999 Chang
D441,192 S 5/2001 Park
D492,595 S 7/2004 Chang
6,935,505 B1 * 8/2005 Nash et al. ..... 206/562
6,966,447 B2 * 11/2005 Hiltke et al. ..... 211/132.1
2005/0115868 A1 6/2005 Hong et al.
2005/0150814 A1 7/2005 Tallon
2006/0180496 A1 * 8/2006 Miner et al. ..... 206/581

* cited by examiner

*Primary Examiner*—Jacob K Ackun, Jr.
*Assistant Examiner*—Robert Poon
(74) *Attorney, Agent, or Firm*—Leydig, Voit & Mayer, Ltd.

(57) ABSTRACT

A packaging arrangement for preformed artificial nails and/or nail tips that includes a display that presents the profile contour of at least one nail, wherein the display includes a card having a front wall and at least one side wall, the front wall including at least one opening therethrough that supports said nail in profile contour. Embodiments of the display include a U-shaped cross-section, a second wall disposed substantially parallel to the front wall and having a mating opening for supporting the nail, indicia on the front wall, and two nested U-shaped cross-section structures.

17 Claims, 6 Drawing Sheets

58
52

54
56
50
Medium Arch
80
60
22
High Arch

PACKAGING ARRANGEMENT FOR ARTIFICIAL NAILS

FIELD OF THE INVENTION

The present invention relates to human nail decorations, and more specifically the invention pertains to the packaging of preformed artificial nails and tips for placement over and adherence to human nails.

BACKGROUND OF THE INVENTION

Well manicured hands and feet present a polished, professional appearance. A major factor in such a manicured appearance is the presentation of ones nails. Many individuals are unable or unwilling, however, to grow or maintain healthy nails of a desired length or uniformity. Alternately, they may not have the time, skill, or financial wherewithal to maintain or obtain a more finished appearance that may result from well manicured and/or polished nails. As a result, entire industries have developed around the artificial supplementation and enhancement of natural nails.

Such enhancements may range from manicuring and polishing of natural fingernails to individually building artificial nails on the natural nail and nail form from an acrylic powder and liquid which chemically bond to the nail surface as the artificial nail is built. Prior to application of an acrylic nail, a bonding agent or primer is applied directly to the natural nail. Typically, a form is placed subjacent the free edge of the user's finger nail or a tip portion is applied to the finger nail when the user desires a lengthening of the natural nail. Acrylic nails are built up and formed directly on the user's own finger nail and the form and/or tip from a mixture of an acrylic liquid (typically methacrylate ester) and an acrylic powder (typically methacrylate copolymer). The operator then dips an applicator brush in the liquid and powder are mixed together to provide a flowable acrylic resin that is repeatedly brushed over the length of the nail and tip and/or form to develop an acrylic nail. The acrylic literally bonds with the user's own fingernail. Although kits are available for home fabrication of such acrylic nails, acrylic nails are typically formed in salons. While such acrylic nails are relatively durable, the process of fabricating acrylic nails is time consuming and can be expensive. The use of acrylic nails also requires regular maintenance as the user's natural nails grow out. Finally, because the acrylic bonds to the nail surface, removal of such acrylic nails from the user's natural nails requires particular chemicals or mechanically prying the developed acrylic nail from the natural nail surface, and can still result in damage to the natural nail.

Between these two extremes of time-consuming manicures and the creation of acrylic nails, are preformed, artificial nails that are glued or otherwise bonded to a person's own naturally occurring fingernails. Such nails are readily available to a wide range of users through drug and department stores. Such preformed artificial nails may be clear or opaque, and/or prepolished and/or decorated to provide the desired appearance. Preformed artificial nails provide users with a relatively quick and economical means by which to provide a polished, manicured appearance.

Such preformed artificial nails are traditionally made of plastic materials such as acrylonitrile butadiene styrene (ABS), polyethylene or polypropylene and are secured to the user's nail with an adhesive. The preformed nails may be removed using commonly available acetone nail polish remover, which dissolves the adhesive to separate the preformed nail from the natural nail. Preformed artificial nails may either be polished or decorated once applied, or the preformed nail may include color and/or other decoration prior to application. For the purposes of this disclosure, the term "preformed artificial nail" shall mean an artificial nail that is molded, by injection molding or other method of fabrication, into a complete, discrete nail that may then be secured to the user's natural nail, rather than a nail that is formed directly on the user's nail, as with the acrylics described above.

Preformed artificial nails are provided in a variety of lengths to extend the free edge of the user's nail from a relatively short, sportier amount to relatively long, glamorous lengths. Moreover, the free edge of such artificial nails is provided in a variety of shapes to meet the user's preference as to how one might file one's own nails.

Preformed artificial nails are traditionally supplied in either a full nail form or a nail tip form. As indicated by the name, full nails simulate a complete nail, including nail bed and free edge and are adhered thereto, covering the entire nail, including the nail bed and free edge of the nail. The proximate edge is shaped to be disposed substantially adjacent or abut against the cuticle of the finger. In contrast, nail tips do not simulate the complete nail, but, rather, only the free edge and, typically, a small extended portion to cover only a portion of the nail bed in order to facilitate attachment to the nail. In use, nail tips are secured to the edge of the nail bed adjacent the free edge and the tip only.

The distal free edge may have any of various lengths and shapes, such as oval, square, or flared, depending upon the desired look. Additionally, to further simulate a natural fingernail, the artificial nail is typically formed with a curvature between a first side edge and a second side and a curvature between the proximate and distal edges. Preferably, the artificial nail is sufficiently durable and rigid to withstand the hazards inherent in its use.

Manufacturers typically provide users with a range of nail sizes, e.g., identified by size numbers 0-9, to accommodate most nail sizes. Generally, artificial nails are packaged together in sets including a range of different sizes so that the purchaser receives differently artificial nails for their different fingers. In addition to the set of different sized artificial nails, the package may also include liquid adhesive and/or peel-off adhesive pads for bonding the artificial nails to the purchaser's natural fingernails.

It is well known, however, that the contour of natural fingernails varies greatly between individuals and even between different fingers on the same individual. It has been difficult, if not impossible, to produce artificial nails having degrees of curvature between the first and second side edges and proximate and distal edges that accommodate all natural fingernails. While manufacturers may produce a large number of artificial nails with a variety of curves, this solution is undesirable and impractical because of the associated increase in manufacturing costs. As a result, manufactures typically produce a set of preformed artificial nails have varying widths and including set degrees of curvature.

Variations between the curvatures of the preformed artificial nail and the natural nail, however, may affect the integrity of the attachment to the nail, the comfort to the wearer, and the aesthetic appeal of the nail when secured to the natural nail. For example, some individuals have one or more relatively flat nail beds. When attaching an artificial nail that is more curved than the natural nail bed, there will be a gap between the artificial and natural nail bed. In order to adequately bond the artificial nail to the nail bed, a proportionally greater amount of adhesive must be applied. The best bond, however, is obtained from a thin layer of glue between adjacently disposed artificial and natural nail surfaces. A greater amount of glue may result in the formation of air pockets within the volume of glue, weakening the bond. Consequently, the use of a greater amount of glue may actually result in a less durable bond between the artificial and natural nails, and shorten wear time. Moreover, when the user presses the more arched artificial nail downward against the flatter natural nail bed of the user, and the bond is established, the artificial nail will seek to return to its natural, more arched free position. As a result, this pulling on the natural nail bed can cause the user significant pain and discomfort.

To minimize the chances of formation of air pockets within the layer of glue between the artificial and natural nails, and thereby provide a stronger bond between the artificial nail and the natural fingernail and a reduction in user discomfort, it has been proposed that the preformed artificial nail be permitted to flex and conform to the curved shape of a nail bed of a natural fingernail along the nail bed portion. As set forth in U.S. Provisional Application 60/601,895 and PCT Application PCT/US0529170, which are incorporated herein by reference for all disclosed therein, to enable the artificial nail to conform to the nail bed of the wearer, the thickness of the artificial nail body may increase between the proximate edge and the distal edge. Accordingly, the portion of the nail body corresponding to the proximate edge is sufficiently thin to demonstrate a degree of flexibility while the portion corresponding to the distal end is sufficiently thick to provide strength to the artificial nail. In this way, the flexibility of the artificial nail increases as along the length of the nail from a relatively rigid distal end portion to a relatively flexible proximate portion. Thus, the flexibility associated with the portion of the artificial nail corresponding to the proximate edge allows that portion of the artificial nail to be pressed adjacent to the nail bed. More specifically, the flexible portion of the artificial nail can deform to mirror the curve of the nail bed between the first and second sides of the wear's own natural fingernail. As a result, the inventive nail will result in a reduction, and, sometimes, elimination of the pain often caused to the user by the arched nail seeking to return to its free state and exerting and upward force on a flatter natural nail bed.

In selecting between the various nail curvatures, or the flexible nail described above, however, the user is typically left with little more than a written description of the same and/or possibly a picture or artist's rendition of the curvature of the nail. Accordingly, it may be difficult for the user to choose the nail design that is appropriate for her particular nail profile. U.S. Application Publication US 2005-0150814 A1 in the name of Kiss Nail Products, Inc., discloses a "Combination package for artificial fingernails". The package of the '814 publication includes a sponge-like block through which the nails are disposed in order to display the curvature. This arrangement, however, does not provide for further guidance to the potential purchaser regarding the attributes in the nails displayed beyond the accompanying packaging. Moreover, the block of sponge material is relatively voluminous.

BRIEF SUMMARY OF THE INVENTION

The invention provides a packaging arrangement for preformed artificial nails or nail tips (collectively referred to as "preformed artificial nails" in the specification and in the claims) that includes a display that presents the profile contour of at least one nail, wherein the display includes a card having a front wall and at least one side wall, the front wall including at least one opening therethrough that supports said nail in profile contour. The display may be formed with a U-shaped cross-section. It may additionally include a second wall disposed substantially parallel to the front wall and having a mating opening for supporting the nail. The second wall may be formed as part of the basic front and side wall. Alternately, the second wall may be included in a second U-shaped cross-sectional structure that nests with a first such structure.

The display is preferably formed from a flat card stock or polymeric material in a sheet form. In this way, the flat sheet is bent into the final display arrangement.

Preferably, the display includes indicia that provide information to the potential user regarding the displayed nail. The indicia may be printed or formed directly on the display or secured thereto.

The kit may further include an adhesive, a towelette including a cleaner, a roughening surface, a stick, and/or a placement tool.

These and other objects and advantages of the invention will be apparent to those skilled in the art upon reading the following summary and detailed description and upon reference to the drawings.

DETAILED DESCRIPTION OF THE INVENTION

Figure 1:
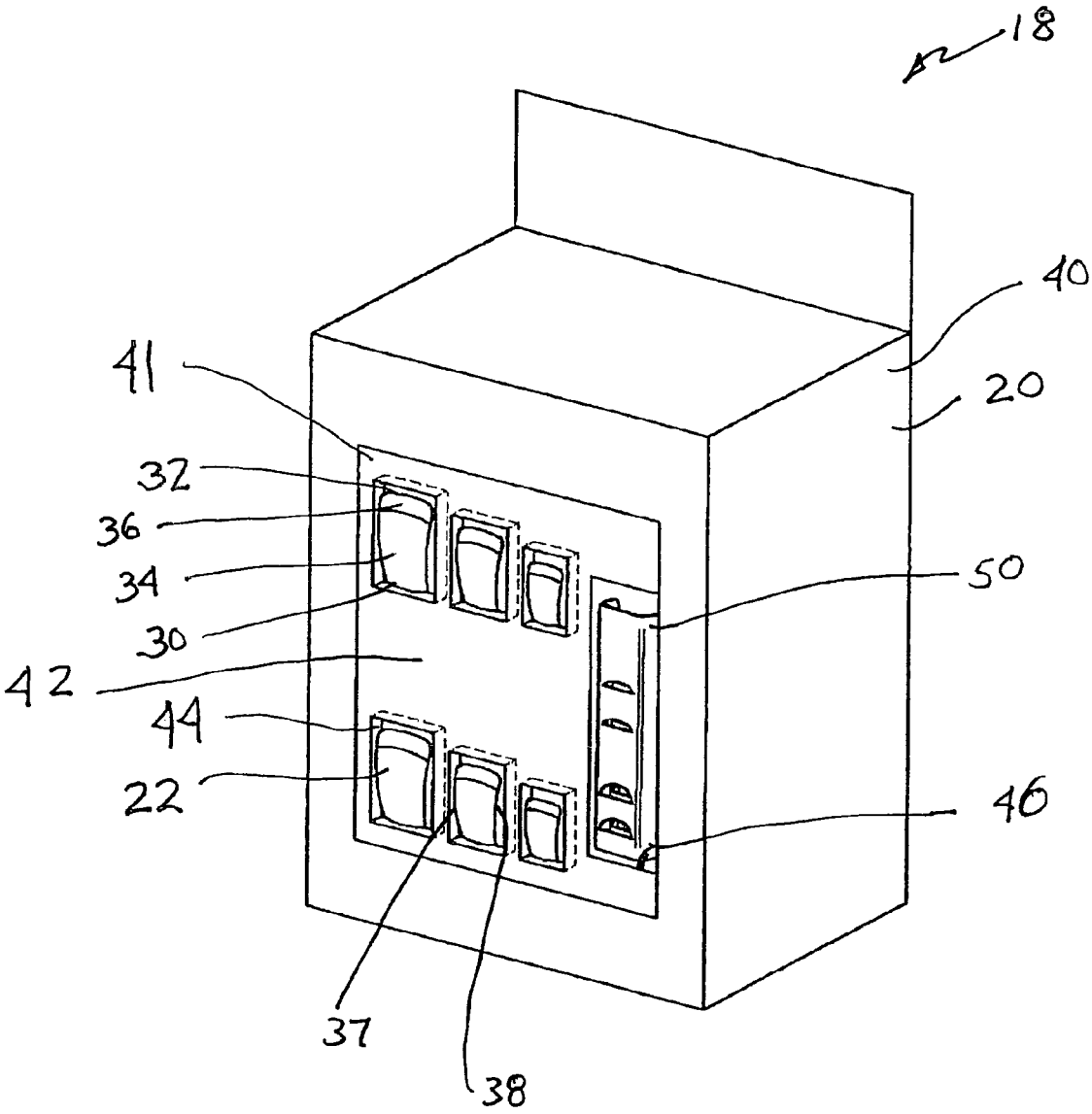
FIG. 1 is a perspective view of a packaging arrangement constructed in accordance with teachings of the invention.
Figure 2:
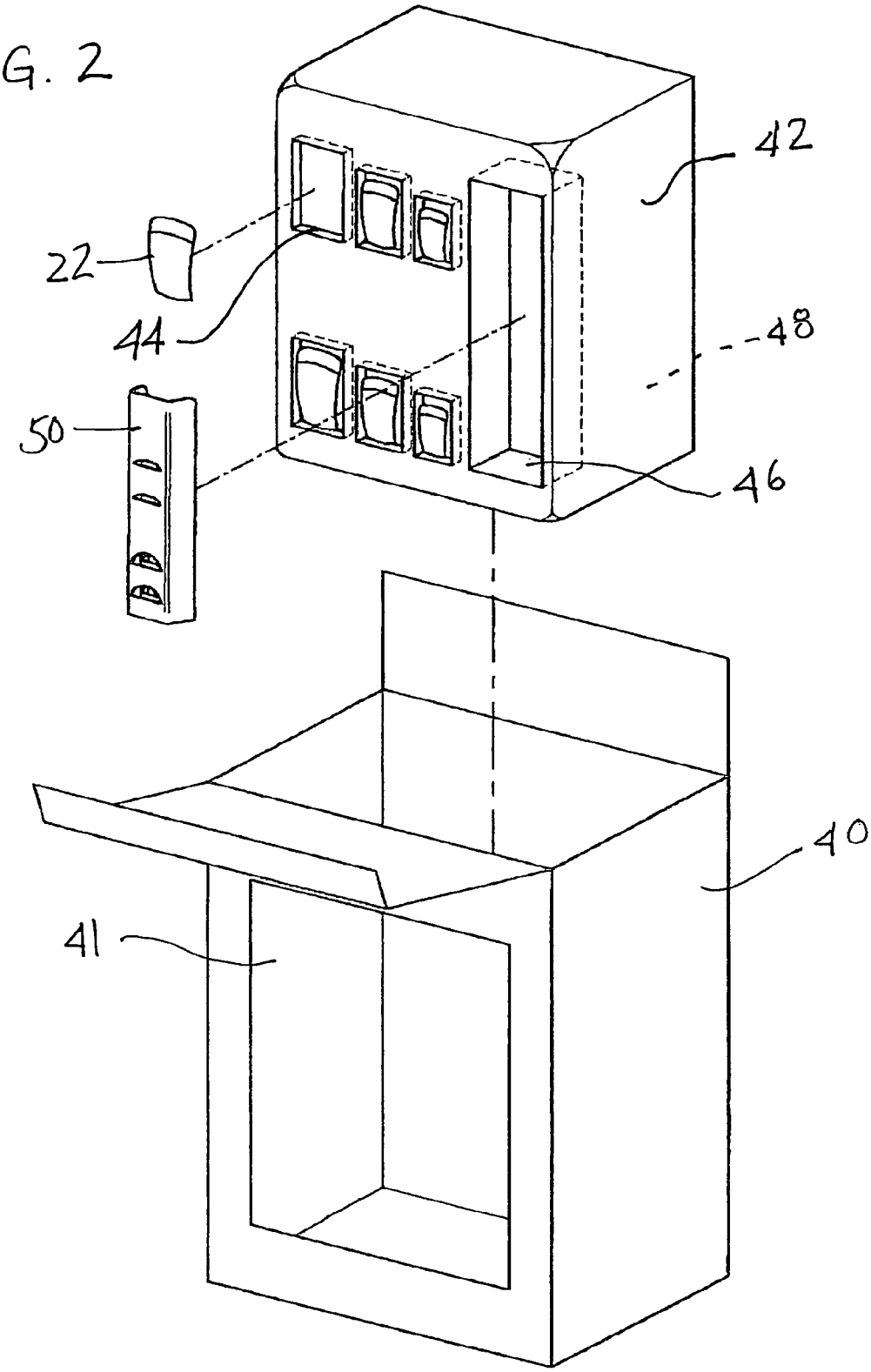
FIG. 2 is an exploded perspective view of the arrangement of FIG. 1.

Turning now to the drawings, wherein like reference numbers refer to like elements, there is illustrated in FIG. 1 a nail kit 18 comprising a package 20 containing a plurality of preformed artificial nails 22. Each artificial nail 22 includes a nail body having a generally convex upper surface and a generally concave lower surface. Each nail 22 further comprises a proximal end 30, adapted to be placed generally adjacent the user's cuticle, and a distal end 32 that is generally disposed at or beyond the end of the user's natural nail when properly placed. The areas between the proximal and distal ends 30, 32 of the artificial nail 22 generally define the nail bed portion 34 and the free end 36, the nail bed portion 34 being adapted to be placed adjacent the user's natural nail bed and the free end portion 36 being adapted to extend beyond the end of the user's finger. The artificial nails 22 further include right and left side edges 37, 38 with the nail 22 having a generally arched contour between the side edges 37, 38.

The nail kit package 20 typically includes an outer covering 40, here in the form of a box, having at least one transparent portion 41 for viewing the contents of the package 20. The package 20 further includes an inner support housing 42 that generally retains the contents of the package 20 in position within the package 20. The inner support housing is typically formed of a polymeric material. The inner support housing 42 generally includes a plurality of recessed areas 44, 46, and additional contents of the package 20 may be retained in a rear open portion 48 of the inner support housing 42. In the illustrated embodiment, a plurality of such recessed areas 44 display a plurality of artificial nails 22 in a plan view, while the recessed area 46 retains a display arrangement 50 for displaying at least one of the artificial nails 22 from an end profile such that the potential user may view of the contour between the side edges 37, 38 of the nails 22.

Figure 3:
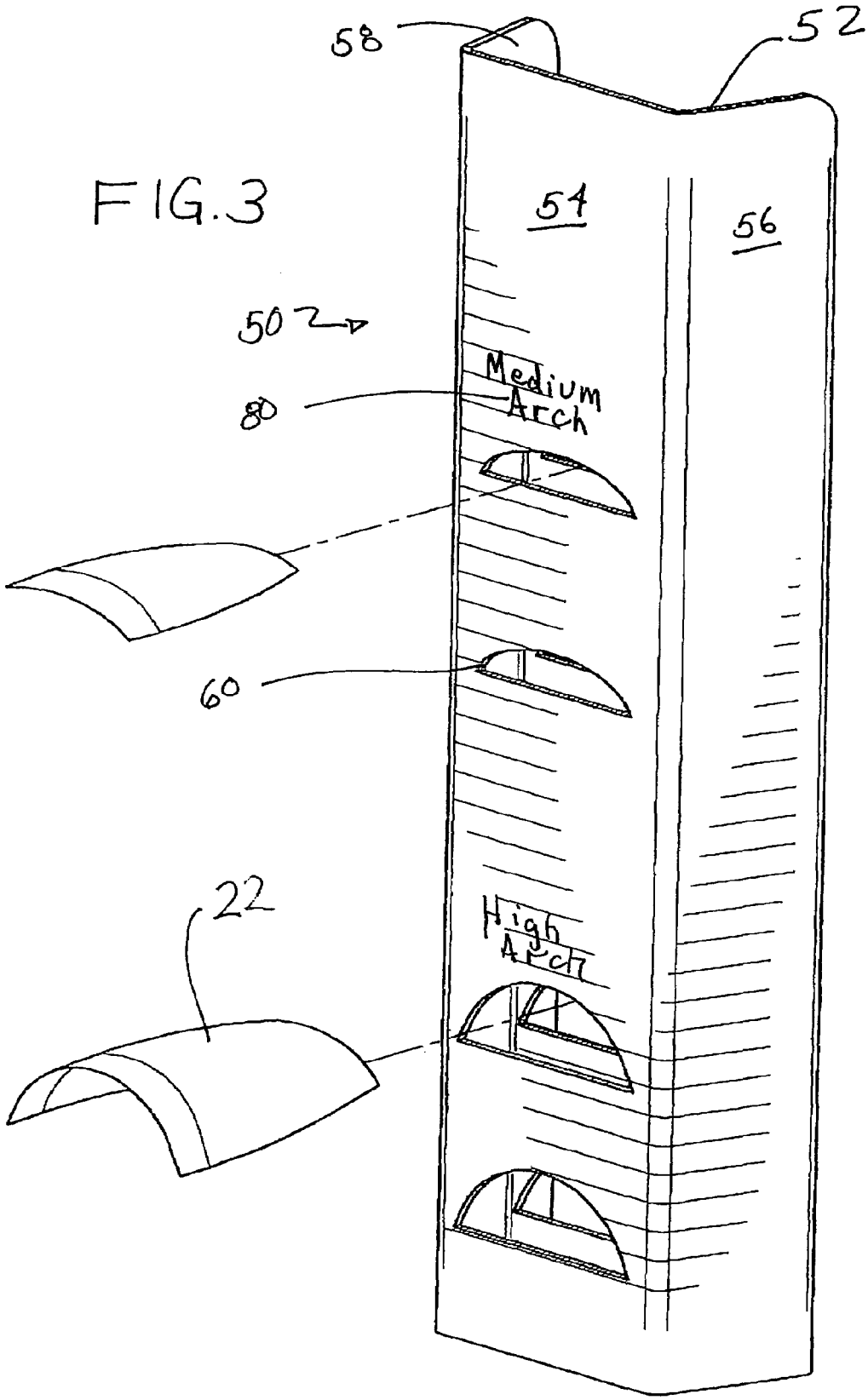
FIG. 3 is an enlarged, front perspective view of the display arrangement of the packaging arrangement of FIG. 1.

In accordance with the invention, the display arrangement 50 is of a construction that is readily fabricated and stored for shipment. As shown in greater detail in FIG. 3, the display arrangement 50 comprises a U-shaped channel 52 having a front wall 54 from which side walls 56, 58 depend. At least one opening 60 extends through the front wall 54 of the display arrangement 50 such that an artificial nail 22 may be disposed therein. In order to stabilize the artificial nail 22 within the opening 60, the opening 60 is preferably of a generally arcuate or sector shape.

Figure 4:
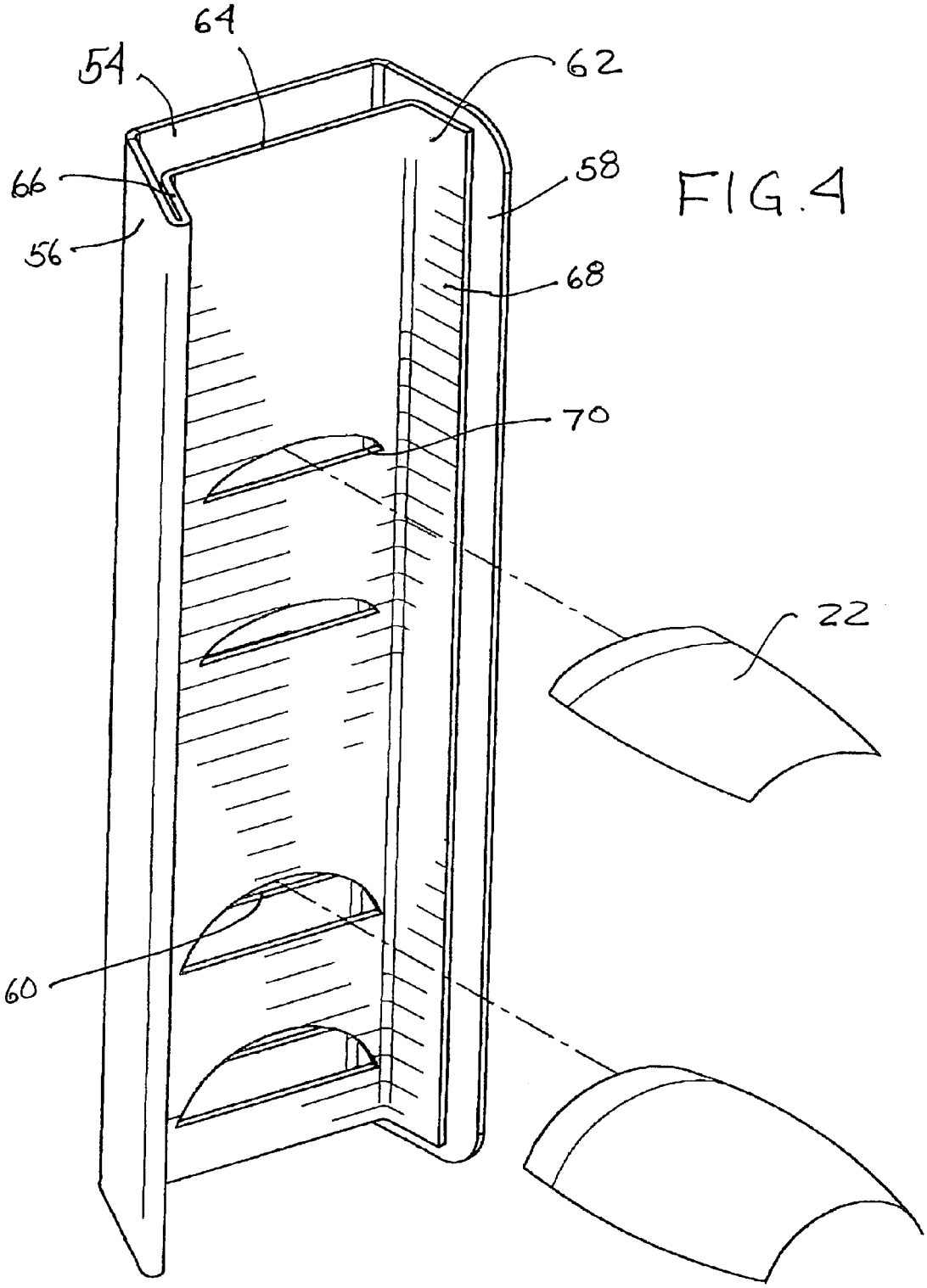
FIG. 4 is an enlarged, rear perspective view of the display arrangement of FIG. 3.

As shown in FIG. 4, in a preferred embodiment, the display arrangement 50 additionally includes a second U-shaped channel 62 wherein the front wall 64 of the second U-shaped channel 62 is disposed substantially parallel to, but spaced away from the front wall 54 of the first U-shaped channel 52. In order to further stabilize an artificial nail 22 when disposed in the first opening 60, the front wall 54 of the second U-shaped channel 62 likewise includes at least one opening 70 therethrough that is disposed generally behind the opening 60 in the first U-shaped channel 52. As with the first opening 60, the second opening 70 is preferably generally arcuate or sector shape. In the illustrated embodiment, the second U-shaped channel 62 likewise includes side walls 66, 68 that depend from the front wall 64 such that the U-shaped channels 52, 62 are nested. It will be appreciated by those of skill in the art that the shape and execution of the display arrangement 50 may be varied from the illustrated design without departing from the invention. By way of example only, the second front wall 64 may not be a part of a separate U-shaped channel, but may simply be a back face to the first U-shaped channel 52.

Figure 5:
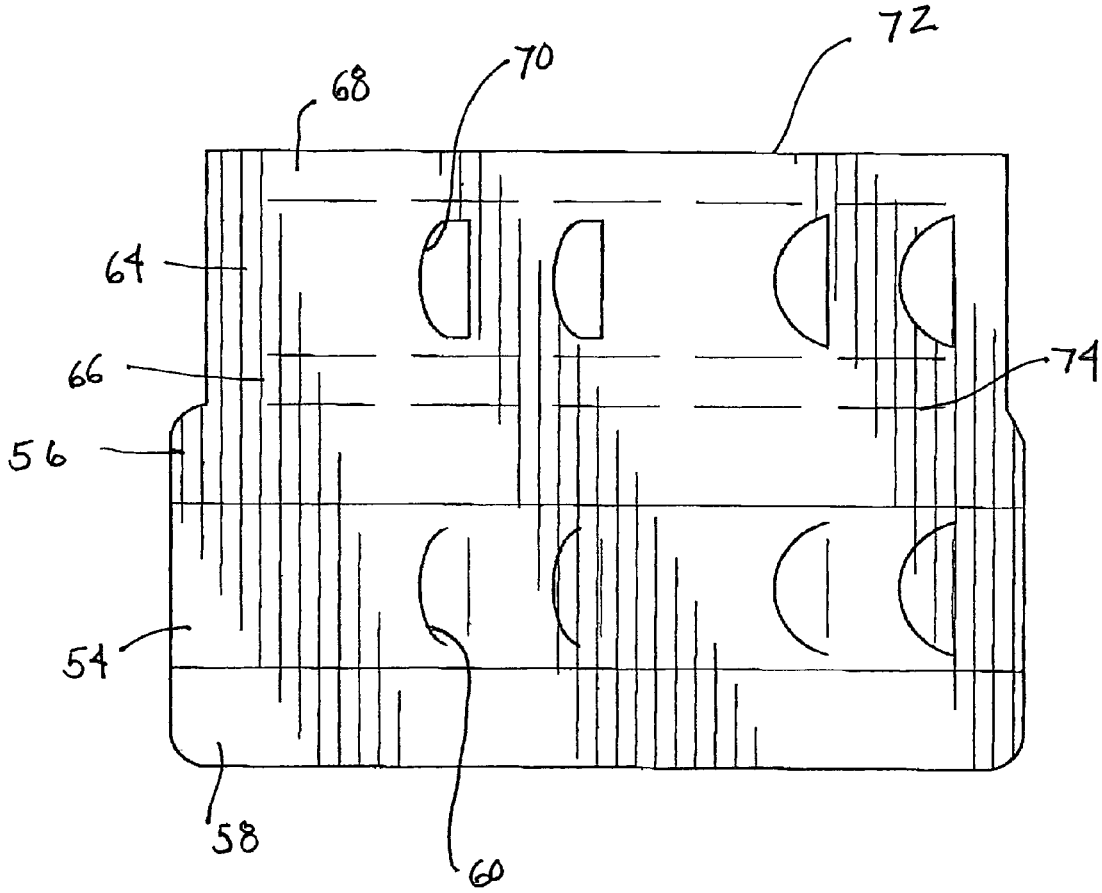
FIG. 5 is an enlarged plan view of the display arrangement of FIGS. 3 and 4 laid flat.

In an embodiment of the invention, the display arrangement 50 is formed as a flat structure 72, as shown in FIG. 5. In the illustrated embodiment, the flat structure 72 includes portions that correspond to the front wall 54 and side walls 56, 58 of the first U-shaped channel 52, as well as the front wall 64 and side walls 66, 68 of the second U-shaped channel 62. It further includes the openings 60, 70. In this embodiment, the openings 60 are merely a slit of an arcuate shape, while the openings 70 include such an arcuate shape, but are larger openings shaped as a sector. In order to facilitate final shaping of the display arrangement 50, the flat structure 72 may further include score lines or perforations 74 that extend along those lines where that flat structure 72 is to be folded to shape it into the final display arrangement 50.

The display arrangement 50 is preferably formed of a thin sheet of polymeric material, such as, for example, polyethylene or polypropylene, or card stock. The arrangement 50 may be fabricated by any appropriate method, including, for example, stamping. It will thus be appreciated by those of skill in the art that this flat structure may be easily and economically fabricated. Moreover, when shipped as a flat structure 72, a large volume of the flat structures 72 may be shipped as a very compact unit. Similarly, even when the display arrangement 50 is in its final U-shaped structure, a plurality of the arrangements 50 may be nested and compactly shipped.

Figure 6:
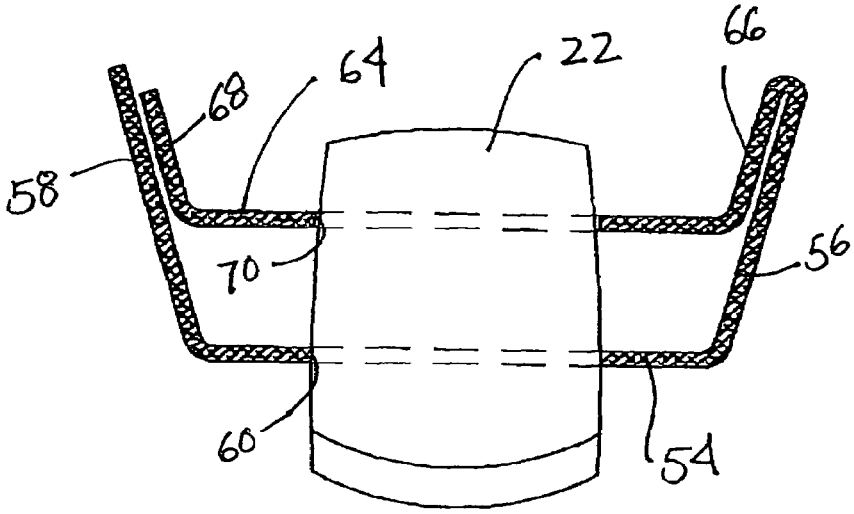
FIG. 6 is an enlarged cross-sectional view of the display arrangement of FIGS. 3-5 supporting a preformed artificial nail.
Figure 7:
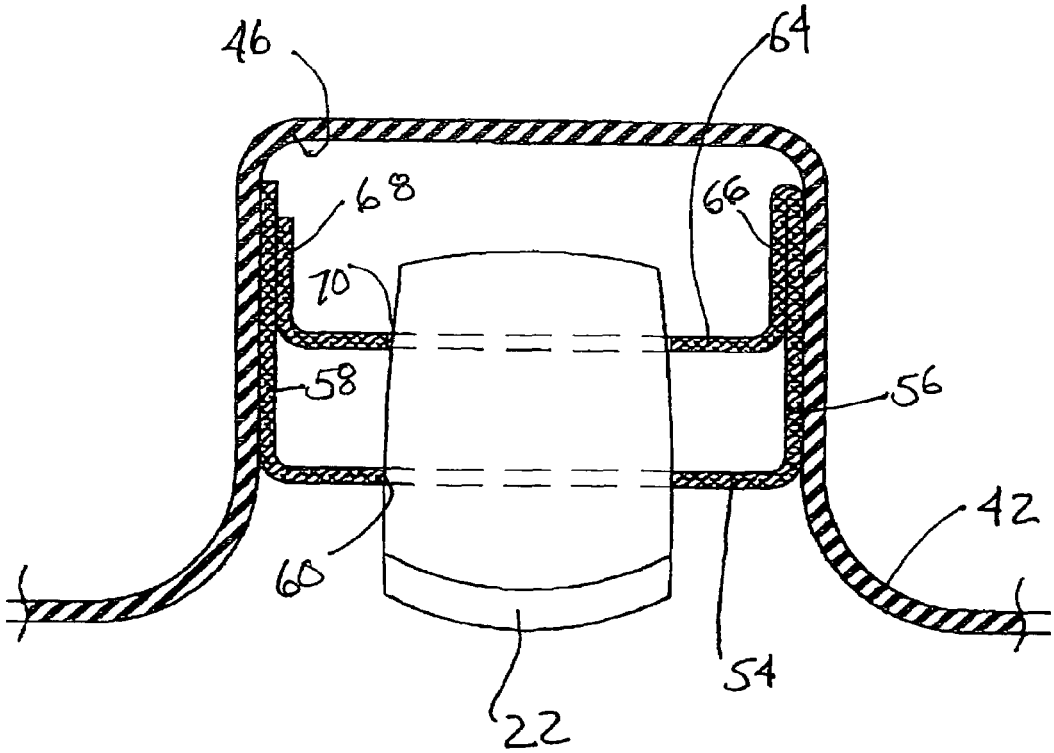
FIG. 7 is an enlarged, fragmentary cross-sectional view of the packaging arrangement of FIG. 1, showing the display arrangement of FIG. 6 nested within a display card.

In use, the flat structure 72 shown in FIG. 5 is bent along lines 74 to form the nested generally U-shaped channels 52, 62 shown in FIG. 6. The display arrangement 50 is then inserted into the recess 46 in the inner housing structure 42, as shown in FIG. 7. In this way, when the artificial nail is inserted into end held in the openings 60, 70, it is maintained in a manner whereby the potential user may readily view the contour of the nails 22.

According to another aspect of the invention, the display arrangement 50 is particularly suited for display of indicia 80 regarding the particular nails 22 displayed in profile. Advantageously, such indicia 80 may be provided directly on the display arrangement 50 as shown, in FIG. 3. Alternately, a small placard may be provided and coupled to the display arrangement 50 in this way, the user may utilize the displayed nails 22 for reference, even when the display arrangement is separated from the remainder of the nail kit 18.

It will be appreciated that the preformed artificial nails utilized in the nail kit 18 may be of any appropriate design. Moreover, the nail kit may include additional items, such as, by way of example only, an appropriate adhesive, a rough or emery type surface for buffing the natural nail prior to placement of the artificial nail, a towelette including an acetone or other substance to clean the nail prior to placement, a rosewood stick and/or an application tool for assistance during installation of the artificial nail onto the natural nail surface. Such a tool is disclosed, for example, in U.S. Provisional Application 60/634068.

While this invention has been described with an emphasis upon preferred embodiments, variations of the preferred embodiments can be used, and it is intended that the invention can be practiced otherwise than as specifically described herein. Accordingly, this invention includes all modifications encompassed within the spirit and scope of the invention as defined by the following claims.

All of the references cited herein, including patents, patent applications, and publications, are hereby incorporated in their entireties by reference.

The invention claimed is:

1. A kit of preformed artificial nails comprising:

a plurality of artificial nails having right and left sides with a contour therebetween, a display arrangement comprising at least one channel having a front wall, and at least one side wall depending from the front wall, the front and side walls being relatively thin structures with a bend between the front and side walls, the front wall comprising at least one opening therethrough, at least one of said artificial nails being supported in a profile within said opening such that the contour is visible, the display arrangement further comprising a second wall having at least one opening, said second wall being disposed relative to the front wall such that the supported nail extends through both the at least one opening in the front wall and the at least one opening in the second wall, and a package, the artificial nails and the display arrangement being disposed within the package.

2. The kit of claim 1 wherein the display arrangement is formed of a polymeric sheet.

3. The kit of claim 1 wherein the display arrangement is formed of a card stock.

4. The kit of claim 1 wherein the display arrangement further comprises indicia.

5. The kit of claim 4 wherein said indicia relate to said supported nail.

6. The kit of claim 4 wherein said indicia are printed on said display arrangement.

7. The kit of claim 4 wherein said indicia are printed on a placard that that is secured to said display arrangement.

8. The kit of claim 1 wherein the opening comprises an arcuate shape.

9. The kit of claim 8 wherein the opening is of a sector shape.

10. The kit of claim 1 wherein the display arrangement comprises at least two side walls.

11. The kit of claim 1 wherein the display arrangement comprises a substantially U-shaped cross-section.

12. The kit of claim 1 wherein the display arrangement comprises two nested substantially U-shaped cross-sections.

13. The kit of claim 1 wherein the display arrangement is a sheet that is bent to form the front and side walls.

14. The kit of claim 13 wherein the sheet comprises at least one of a score line and perforations.

15. The kit of claim 1 wherein the package comprises at least one recessed area, said display arrangement being disposed within said recessed area.

16. The kit of claim 15 wherein the package comprises at least two recessed areas, an artificial nail being disposed in at least one said recessed area.

17. The kit of claim 1 further comprising at least one of the following: an adhesive, a nail wipe, a manicuring tool, and a placement tool.

* * * * *